United States Patent [19]

Prentice

[11] Patent Number: 4,807,362

[45] Date of Patent: Feb. 28, 1989

[54] HIDDEN BELT WEAPON

[76] Inventor: Charles H. Prentice, 423 Lime Hollow Rd., Verona, Pa. 15147

[21] Appl. No.: 82,036

[22] Filed: Aug. 5, 1987

[51] Int. Cl.[4] ..... B26B 3/06

[52] U.S. Cl. ..... 30/155; 30/303

[58] Field of Search ..... 30/303, 155, 151, 156

[56] References Cited

U.S. PATENT DOCUMENTS

| | | | |
|---|---|---|---|
| 2,162,654 | 6/1939 | Vaisey | 30/155 |
| 3,600,729 | 8/1971 | Laughlin | 7/11 |
| 4,027,389 | 6/1977 | Atchisson | 30/303 |
| 4,096,629 | 6/1978 | Levine | 30/152 |
| 4,313,230 | 2/1982 | Chovaniec | 2/322 |
| 4,389,775 | 6/1983 | Collins | 30/156 |
| 4,466,561 | 8/1984 | Slaughter | 224/163 |
| 4,481,712 | 11/1984 | Phelps | 30/151 |
| 4,494,310 | 1/1985 | Slaughter | 10/155 |
| 4,606,125 | 8/1986 | Jensen | 30/302 |

*Primary Examiner*—Donald R. Schran
*Assistant Examiner*—Willmon Fridie, Jr.
*Attorney, Agent, or Firm*—Webb, Burden, Ziesenheim & Webb

[57] ABSTRACT

The present invention is a hidden belt weapon which, by means of a simple twisting motion on the part of its wearer, detaches from a belt and simultaneously deploys to a "throwing-star" or "Ninja star" configuration. The operative belt-fastening means (the buckle proper) need not detach with the weapon. More particularly, the hidden belt weapon comprises a backing within which is mounted a central rotating member. A plurality of knife blades are rotatably attached to the periphery of the central rotating member by means of a plurality of blade deployment pins. When the central rotating member and the knife blades are in their collapsed configuration, the member and blades are concealed by the cover. Concealment of the blades by the cover enables the user to carry the weapon in a highly-accessible position on the body, such as over the belt buckle, without detection of the weapon. When the cover is grasped and twisted, however, the four blades deploy to an extended position, with the blade tips exterior to the cover, at the same time the cover is released from the attachment shaft which secures it.

12 Claims, 1 Drawing Sheet

HIDDEN BELT WEAPON

FIELD OF THE INVENTION

The present invention relates to hidden belt weapons, for defensive use, which simultaneously may be detached from a belt and converted into a throwing weapon.

INTRODUCTION

Defensive weapons are proving to be increasingly popular in urban societies. Although weapons generally have been carried for years, only recently have men and women carried weapons primarily to defend themselves against attackers and other assailants. A primary disadvantage of a number of defensive weapons inheres, unfortunately, in the offensive capacity such weapons demonstrate when an attacker gains access to it. Accordingly, innovators in this art have attempted to design specialized weapons having primarily defensive utility. As the preferred means for achieving this end, the ideal defensive weapon does not appear to be a weapon at all to anyone but its owner.

BACKGROUND OF THE INVENTION

A number of defensive weapons have been documented in the United States Patent literature. U.S. Pat. No. 4,606,125 to Jensen discloses a throwable weapon which, when deployed, comprises a throwing star (also known as a "Ninja star"). The throwable weapon comprises a pair of plates connected together so that one plate can be pivoted relative to the other plate. When one plate is pivoted, a series of knife blades is caused to protrude circumferentially and the resulting throwing star has utility as a self-defense projectile.

Another defensive weapon, a multiply-bladed retractable "claw," is disclosed in U.S. Pat. No. 4,096,629. The pocket-sized weapon has claw-like projected blades which, for storage and handling, are retractable. The weapon is adapted for rapid conversion to the activated position, and it does not appear to be a weapon until it is deployed by its owner.

A number of defensive weapons known in the art comprise knife blades concealed in the belts of wearing apparel. Exemplary of belts concealing knives include U.S. Pat. No. 4,313,230, U.S. Pat. No. 4,389,775, U.S. Pat. No. 4,494,310, U.S. Pat. No. 4,466,561, and U.S. Pat. No. 4,481,712. Each of these patents is directed to the provision of a single or primary knife blade within a belt or belt buckle.

Two additional patents which also pertain to throwing stars are U.S. Pat. No. 4,027,389 to Atchisson and U.S. Pat. No. 3,600,729 to Laughlin. The foldable throwing knife of Atchisson is intended for use as a throwing weapon; the pocket implement of Laughlin is actually a pocket-sized multiple tool, but the two devices are similar in that they both represent multi-bladed devices from which the blades may be folded away or retracted for safety and/or concealment of the knife blades.

Notwithstanding the various prior art weapons available or otherwise disclosed in the prior art, a need remains for a throwing-star "Ninja" type defensive weapon which may be easily deployed immediately before use and may also be hidden as a part of an easily-accessible element of every day wearing apparel, such as a belt.

SUMMARY OF THE INVENTION

In order to meet this need, the present invention is a hidden belt weapon which, by means of a simple twisting motion on the part of its wearer, detaches from its supporting belt and simultaneously deploys to a "throwing-star" or "Ninja star" configuration. The operative belt-fastening means (the buckle proper) need not detach with the weapon. More particularly, the hidden belt weapon comprises a backing within which is mounted a central rotating member. A plurality of knife blades are rotatably attached to the periphery of the central rotating member by means of a plurality of blade deployment pins. When the central rotating member and the knife blades are in their collapsed configuration, the member and blades are concealed by the cover. Concealment of the blades by the cover enables the user to carry the weapon in a highly-accessible position on the body, such as over the belt buckle, without detection of the weapon. When the cover is grasped and twisted, however, the four blades deploy to an extended position, with the blade tips exterior to the cover, at the same time the cover is released from the attachment shaft which secures it.

DETAILED DESCRIPTION OF THE INVENTION

Figure 1:
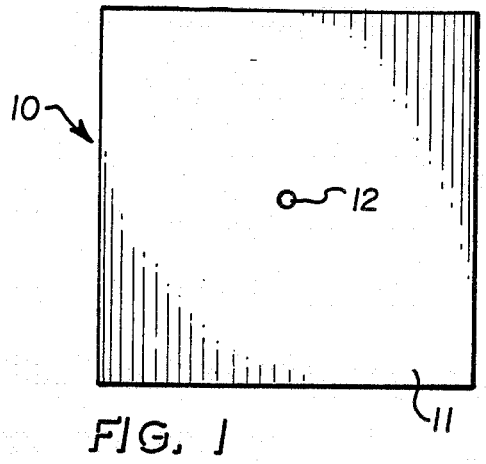
FIG. 1 is a side elevational view of the front cover of the present hidden belt weapon as it appears to an observer standing in front of the wearer.

The present hidden belt weapon, as viewed in every day use, is shown in FIG. 1. FIG. 1 illustrates the hidden belt weapon 10 having a front weapon cover 11 and the visible head of a central axis pin 12. Except for the structures as shown in FIG. 1, no other elements of the hidden belt weapon are visible when the device as shown is worn on the belt of the wearer, for example in position over the belt buckle.

Figure 2:
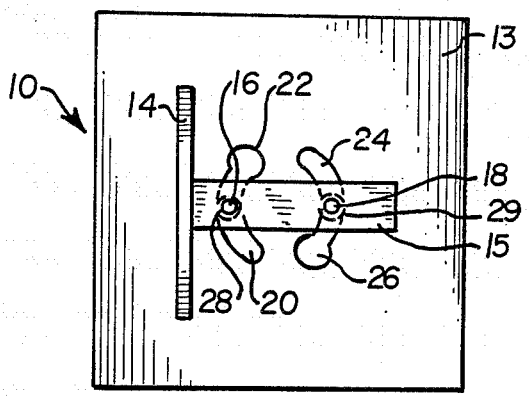
FIG. 2 is a side elevational view of the back of the present hidden belt weapon.

Just as FIG. 1 is a side elevational view of the front of the hidden belt weapon 10, as worn by a wearer, FIG. 2 is a side elevational view of the back of the hidden belt weapon 10, such as is adjacent the wearer. The back weapon cover 13 appears in FIG. 2.

Figure 3:
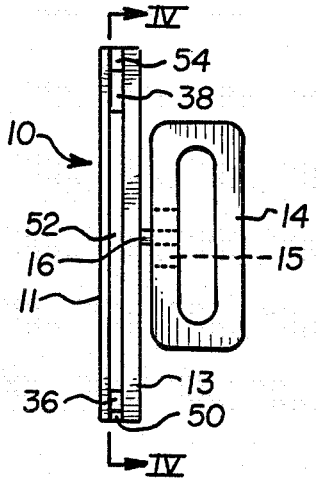
FIG. 3 is an end elevational view of the hidden belt weapon shown in FIGS. 1 and 2, taken from the left of FIG. 2.

In addition to the front and back weapon covers 11, 13, FIGS. 2 and 3 illustrate the mounting loop 14 having an attachment shaft 15 thereon. The mounting loop 14 is adapted to pass over and grip a leather belt (not shown). Permanently attached to attachment shaft 15 are first and second attachment posts 16, 18, which extend perpendicularly from the attachment shaft 15 into the first and second attachment slots 20, 24 in the back weapon cover 13. Because the first and second attachment posts 16, 18 have first and second attachment post heads 28, 29, which are wider than the predominant widths of each of the first and second attachment slots 20, 24, the mounting loop 14 having the attachment shaft 15 thereon is therefore securely affixed to the hidden belt weapon 10 when the combination is configured as shown in FIG. 2.

Original attachment between the mounting loop 14 having an attachment shaft 15 thereon and the hidden belt weapon 10 is made by first inserting the first and second attachment post heads 28, 29 into the widened ends 22, 26 of first and second attachment slots 20, 24, and then by rotating the mounting loop 14 approximately 45° to its position as shown in FIG. 2.

Figure 4:
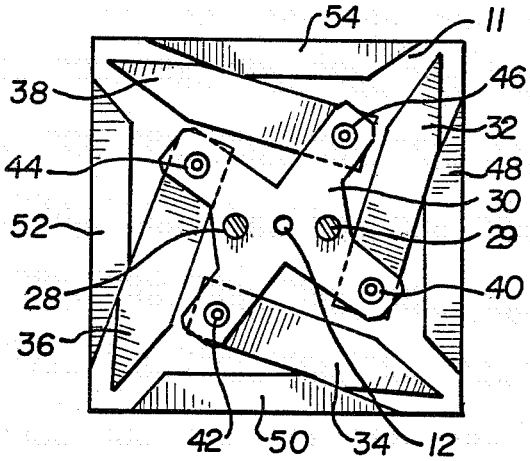
FIG. 4 is a sectional view taken along lines IV—IV of FIG. 3.

The first and second attachment posts 16, 18, as shown in FIG. 2, not only serve to attach the mounting loop 14 to the back weapon cover 13 of the hidden belt weapon 10, but also function to engage the inner workings thereof. First and second attachment post heads 28, 29, shown in dotted-line configuration in FIG. 2, appear in engagement with central crosspiece 30 in FIG. 4. (Central crosspiece 30 is a central rotating member having a plurality of blade deployment pins mounted therewith.) Central crosspiece 30 has two apertures therein to receive the post heads 28, 29; recessed sections of like diameter may be substituted for the apertures. FIG. 4 is a sectional view along lines IV—IV of FIG. 3, and effectively represents a side elevational view of the front of the hidden belt weapon with the front cover 11 (of FIG. 1) removed.

First and second attachment post heads 28, 29 fit within central crosspiece 30, as shown in FIG. 4, to provide a releasably interlocking structure. As described above, the attachment post heads 28, 29, as shown in position in FIGS. 4 and 2, cannot pull free from the central crosspiece 30 because the heads 28, 29 are wider than the first and second attachment slots 20, 24 in the back weapon cover 13, beneath which the post heads 28, 29 are thus secured.

The combined front and back weapon covers 11, 13 (the "weapon cover," generally) and the central crosspiece 30 are permanently mounted together by means of a central access pin 12, which may be a rivet, post, screw, nail or pin so long as rotation is afforded. The weapon cover and the central rotating member are therefore capable of rotation, relative to each other, about the central axis pin 12.

The remaining structures illustrated in FIG. 4 include the first, second, third and fourth blades 32, 34, 36 and 38, each of which is pivotally attached to the central crosspiece 30 by means of first, second, third and fourth blade deployment pins 40, 42, 44, 46, respectively. Adjacent each of the first, second, third and fourth blades 32, 34, 36 and 38 are the respective first, second, third and fourth blade deployment guides 48, 50, 52, 54. The blade deployment guides 48, 50, 52 and 54 have a thickness approximately equal to the thickness of the blades 32, 34, 36 and 38; an end elevational view of blade deployment guides 50 and 54 is shown in FIG. 3.

As is evident from the structures described above and as shown in FIGS. 2, 4 and 5, when the combined front and back weapon covers 11 and 13 (together with the blade deployment guides 48, 50, 52, 54) are rotated approximately 45° clockwise (relative to the facing surface of the attachment shaft 15), the central crosspiece 30 maintains its same position relative to the attachment shaft 15 due to the interlocking first and second attachment posts 16, 18 which secure the attachment shaft 15 to the central crosspiece 30. Rotation of the combined front and back weapon covers 11 and 13, however, brings the first and second widened ends 22, 26 of first and second attachment slots 20, 24 to a position immediately beneath the first and second attachment post heads 28, 29. This enables the hidden belt weapon 10 to be pulled free from the attachment shaft 15 by the user, because the attached first and second attachment posts 16, 18 and the post heads 28, 29 thereon can pass through the widened ends 22, 26 of first and second attachment slots 20, 24. After a simple twisting motion, therefore, the hidden belt weapon 10 may be separated from its mounting loop/attachment shaft structure.

This same approximately 45° clockwise rotation, simultaneously to releasing the hidden belt weapon 10 from the attachment shaft is as described above, also deploys the blades 32, 34, 36 and 38. Upon deployment, the blades have the configuration shown in FIG. 5. (FIG. 5 represents the same sectional view of the hidden belt weapon 10 as that shown in FIG. 4 except that the central crosspiece 30 of FIG. 4 has been rotated counterclockwise about the central axis pin 12 approximately 45°.)

Figure 5:
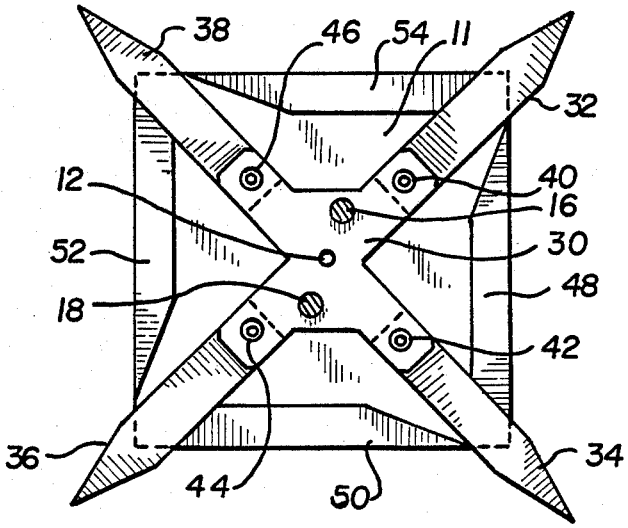
FIG. 5 illustrates, in the same view as FIG. 4, the blades of the present invention as positioned when deployed.

The structures as illustrated in FIGS. 2, 4 and 5 accordingly enable simultaneous deployment of the four blades 32, 34, 36 and 38 at the same time as the hidden belt weapon 10 is released from the attachment shaft 15. The means which enable this simultaneous deployment and release are the means which constitute the present invention.

Beyond these critical means, the present hidden belt weapon is susceptible of endless variation. For example, although the mounting loop 14 is intended to secure the present hidden belt weapon to a belt having its own buckle, such that the loop is positioned near the belt buckle and the hidden belt weapon covers the actual belt buckle, and manner of variation may be made to the structures appending from the mounting loop 14 and/or the attachment shaft 15 to provide for direct belt-fastening means thereon. Because the hidden belt weapon 10 detaches from the attachment shaft 15 at the time the blades are deployed, any manner of belt-fastening means incorporated on the attachment shaft 15 will remain in place and continue to fasten the belt even when the hidden belt weapon 10 is deployed and removed for use. Such belt-fastening means do not contribute to the novelty of the present invention in any way.

The hidden belt weapon of the present invention may be made of a wide variety of materials and within a range of varying dimensions. Generally speaking, however, the hidden belt weapon is preferably fabricated from the various plastics, composites and metal alloys common in the knife and weapon fabricating industries. Except in unusual circumstances, the blades 32, 34, 36 and 38 will be fabricated of metal alloys such as stainless steel, high carbon steel, titanium alloys, etc. These materials lend themselves to the double-blade-edge configuration of the blades 32, 34, 36 and 38 as shown in FIGS. 2, 4 and 5. (In order for the deployed blades to have utility as throwing star blades, the double-blade-edge configuration as illustrated is preferred.) The structures other than the blades may be fabricated of a wider array of materials, including but not limited to plastics, stiff leathers, enameled substrates, woods or composite preparations of two or more of such materials with or without reinforcing fibers or metals.

The dimensions of the hidden belt weapon may include literally any dimensions within which knife blades may be manufactured, but will generally range from about 3 $cm^2$ to 10 $cm^2$ for the broad surface of the weapon cover. Regardless of overall dimension, the blade deployment pins 40, 42, 44, 46 and the central axis pin 12 should have individual dimensions, and should be fabricated of materials, which can withstand the repeated rotation to which the weapon is subjected during repeated use.

Although the invention has been described in terms of the specific embodiment and variations identified above, the invention is to be limited only in so far as is set forth in the accompanying claims.

I claim:

1. A hidden belt weapon, comprising:

a weapon cover having front and back segments thereto, having at least one aperture in the back thereof and having a central axis pin therethrough;

a central rotating member rotatably mounted by means of said central axis pin within said weapon cover and having at least one recessed area therein, said recessed area being a cavity in said central rotating member on the side of said central rotating member facing said back segment of said weapon cover;

a plurality of blades and a plurality of blade deployment pins, wherein each of said plurality of blades is mounted to said central rotating member by means of one of said blade deployment pins; and an attachment shaft having means for engaging said recessed area via said aperture, and further having means for engaging a belt;

whereby rotation of said means for engaging said recessed area via said aperture, together with the rotation of said weapon cover relative to said attachment shaft, deploys said blades to a position exterior to said weapon cover and simultaneously releases said weapon cover from said attachment shaft and likewise from said belt.

2. The hidden belt weapon according to claim 1 wherein said means for engaging said recessed area via said aperture comprises two posts affixed to said attachment shaft.

3. The hidden belt weapon according to claim 2 wherein each of said two posts has a post head thereon, for a total of two post heads, wherein the diameter of said post head is greater than said post.

4. The hidden belt weapon according to claim 3, wherein said weapon cover having at least one aperture in the back wall thereof further comprises a weapon cover having at least two curved slits in the back wall thereof.

5. The hidden belt weapon according to claim 3 wherein said central rotating member has two apertures therein.

6. The hidden belt weapon according to claim 5 wherein each of said curved slits has a narrow body and a widened area at one end.

7. The hidden belt weapon according to claim 5 wherein said two apertures have approximately the same shape and dimension as said two post heads.

8. The hidden belt weapon according to claim 7 wherein said plurality of blades numbers four.

9. The hidden belt weapon according to claim 1 wherein said weapon cover contains a plurality of blade deployment guides affixed to the interior periphery of said weapon cover.

10. The hidden belt weapon according to claim 9 wherein said plurality of blade deployment guides numbers four.

11. The hidden belt weapon according to claim 1 wherein each of said plurality of blades has a double-blade-edge, pointed-tip configuration.

12. The hidden belt weapon according to claim 1 wherein said means for engaging a belt further comprises a loop permanently affixed to said attachment shaft.

* * * * *